United States Patent [19]

Markva

[11] Patent Number: 4,938,390

[45] Date of Patent: Jul. 3, 1990

[54] LIQUID STORAGE CONTAINER WITH DISPENSING CLOSURE

[76] Inventor: Neil F. Markva, 5901 Sherborn La., Springfield, Va. 22152

[21] Appl. No.: 77,696

[22] Filed: Jul. 24, 1987

[51] Int. Cl.[5] ..... B65D 81/24

[52] U.S. Cl. ..... 222/206; 222/207; 222/212; 222/215; 222/490; 222/494; 222/541; 222/545; 215/232; 215/306; 156/69

[58] Field of Search ..... 222/541, 490, 494, 213, 222/215, 206, 207, 212, 1, 153, 545; 220/258, 89 A, 375; 141/364, 366; 215/232, 250, 306, 325; 137/68.1; 156/69, 314; 428/40–42

[56] References Cited

U.S. PATENT DOCUMENTS

| | | | |
|---|---|---|---|
| 2,507,248 | 5/1950 | DeSwart | 222/490 X |
| 3,029,987 | 4/1962 | Gronemeyer | 222/569 X |
| 3,118,573 | 1/1964 | Johnson | 222/212 |
| 3,747,813 | 7/1973 | Downey | 222/541 |
| 4,358,025 | 11/1982 | Urion | 220/258 |
| 4,696,328 | 9/1987 | Rhodes, Jr. | 222/212 X |
| 4,705,197 | 11/1987 | Gordon et al. | 222/541 X |
| 4,789,082 | 12/1988 | Sampson | 222/541 X |

*Primary Examiner*—Kevin P. Shaver
*Assistant Examiner*—Gregory L. Huson
*Attorney, Agent, or Firm*—Neil F. Markva

[57] ABSTRACT

The combination comprises a flexible container including a body portion and a neck portion. The body portion is sufficiently flexible to allow manual squeezing inwardly thereof. An amount of the liquid material is disposed within the container for storage thereof. The neck portion extends from the body portion at one end thereof to a discharge opening defined by a peripheral wall edge at the other end thereof. The sealing closure includes frangible membrane mechanism and a securing mechanism for attaching the membrane mechanism to the wall edge of the discharge opening. The sealing closure being effective to hold the liquid within the container when the container is inverted to otherwise cause the liquid therein to pour out of the discharge opening. The sealing closure has a structural configuration effective to break open causing gravitational liquid flow out of the discharge opening when the inverted container is manually squeezed inwardly.

13 Claims, 2 Drawing Sheets

Fig. 1
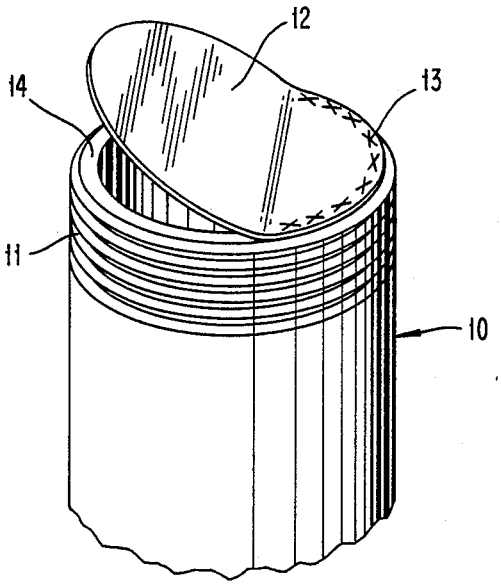
Fig. 2
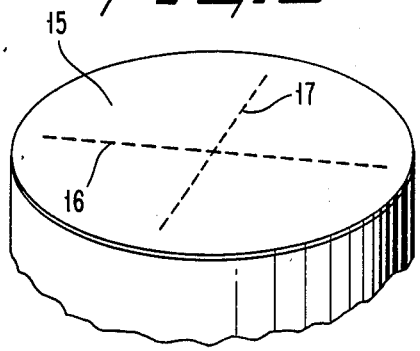
Fig. 2a
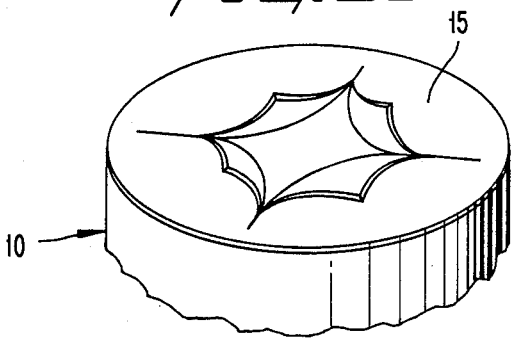
Fig. 4
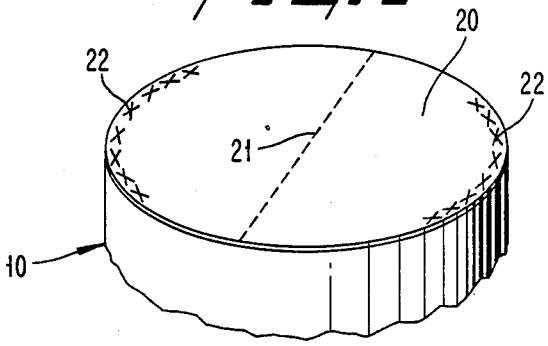
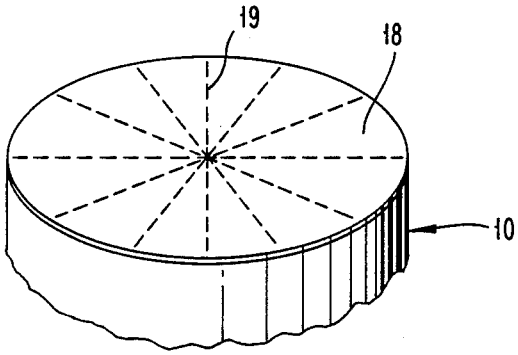
Fig. 3
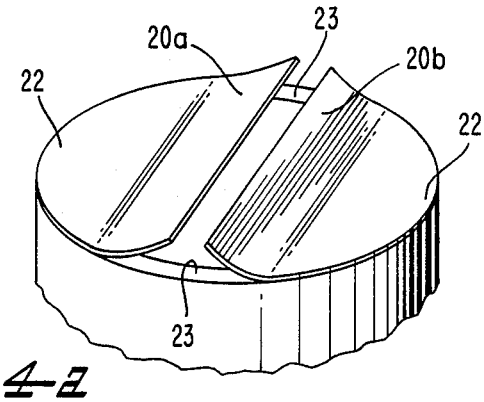
Fig. 4a Fig. 5
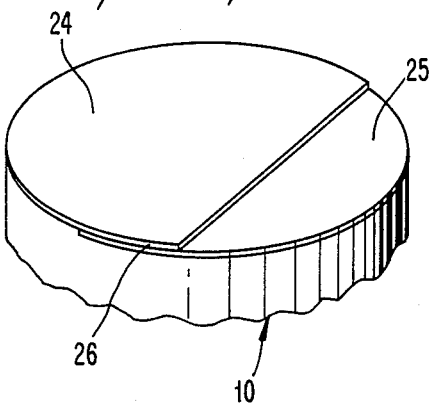
Fig. 6
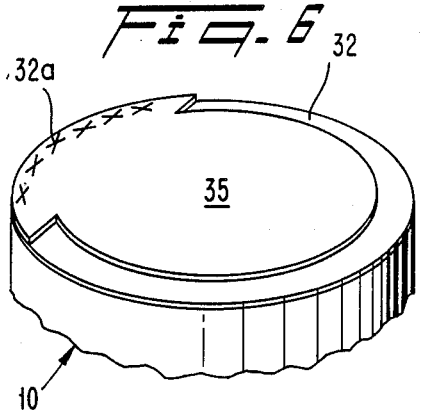
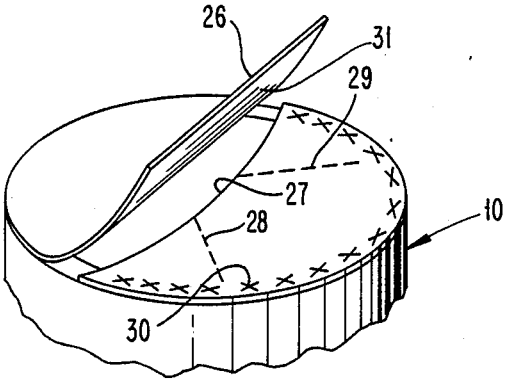
Fig. 5a
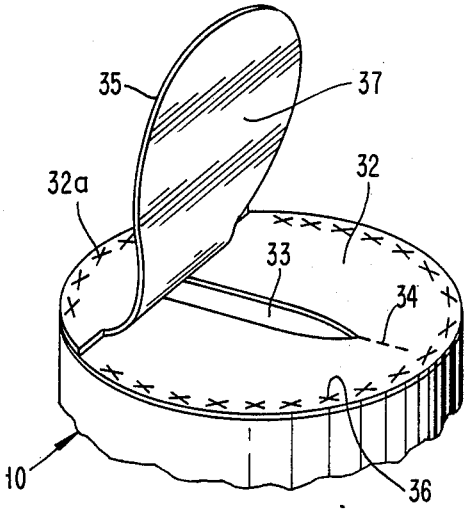
Fig. 6a
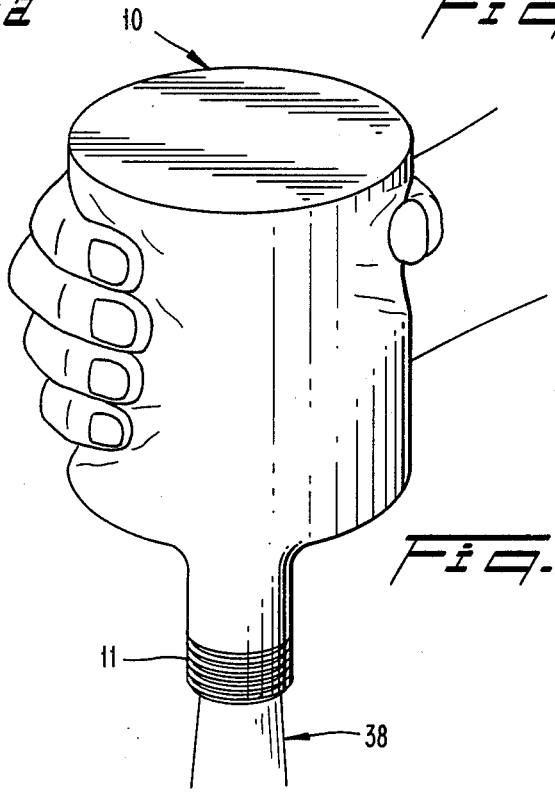
Fig. 7

LIQUID STORAGE CONTAINER WITH DISPENSING CLOSURE

FIELD OF THE INVENTION

This invention relates to a liquid storage container including a body portion with a neck portion having a dispensing opening. More particularly, the invention relates to a resiliently flexible storage container having a closure mechanism disposed across the discharge opening of the neck portion.

BACKGROUND OF THE INVENTION

In recent years, many liquids such as motor oil and transmission fluid have been stored in resiliently flexible plastic containers. The known containers include a neck portion extending outwardly from a body portion with a discharge opening having a cap member threadingly screwed thereover. The external cap member is generally a tamper-proof type cap having a tear strip along its lower peripheral edge which separates when the cap is unscrewed from the neck of the plastic bottle.

In some instances, a thin, frangible sealing member is adhered to the peripheral wall edge defining the discharge opening in the neck portion. Once the external cap is unscrewed, the sealing member is broken to empty the contents of the bottle into the place where it is to be poured. For example, in known motor oil storage containers, the frangible member must be broken to pour the contents into the engine inlet oil opening. Therefore, the discharge opening is necessarily completely open before the storage bottle is inverted. Generally, when the bottle is then inverted, motor oil spills onto the engine before the bottle neck opening is registered with the oil inlet opening into the engine.

A variety of outlet closure mechanisms for squeeze bottles composed of resiliently flexible materials is known. For example, U.S. Pat. No. 4,133,457 discloses a squeeze bottle with a valve septum designed to open upon squeezing the resiliently flexible dispenser bottle. Here, so long as the container is squeezed, the septum remains open and allows liquid to discharge. Once squeezing stops, the septum recloses. Openings in the septem allow air to reenter the bottle for further dispensing when the bottle is squeezed again.

U.S. Pat. No. 4,408,702 discloses an automatic dispenser cap that dispenses material so long as the container is squeezed. Upon release of the bottle, the dispensing valve recloses and air is allowed to flow back into the bottle for the next desired discharge bottle.

U.S. Pat. No. 3,669,323 shows a one-way valve insert usable with a collapsible dispensing container tube for storing highly viscous materials such as toothpaste. Similar types of dispensing devices are disclosed in U.S. Pat. Nos. 2,552,715; 2,679,954; and 3,674,183. Each of these known containers discharges a limited amount of liquid while reclosing when the container is no longer manually squeezed.

U.S. Pat. Nos. 3,241,726; Reissue 29,850; 3,998,354; 4,269,330; and 4,651,885 show various types of one-way valve structures and closure members which perform various types of functions. Such structures are tamper-proof and one-way dispensing when squeezing the container.

U.S. Pat. Nos. 3,986,640; 4,236,652; and 4,493,574 show various types of fault line structures which break open when bending or tearing dispenser packages. These prior art laminated plastic packages are relatively thin and commonly used to dispense ketchup, mustard, salt, pepper, shampoo and the like. Upon fracture, the measured amount of material is accordingly dispensed.

None of these prior art dispensing packages overcome the basic problem associated with a storage container for liquid such as motor oil and transmission fluid to be poured into a relatively small inlet opening on an engine.

SUMMARY OF THE INVENTION

The primary object of the invention is to provide a liquid storage container with a sealing closure wherein the filled container may be inverted without discharging liquid until manual squeezing produces additional internal pressure to thereby break open the sealing closure allowing gravitational liquid flow from the container.

Another object of the invention is to provide a closure member which prevents spilling liquid such as motor oil from an inverted container while registering the container discharge opening with an inlet opening of an engine.

The combination of the invention comprises a resiliently flexible container means including a body portion and a neck portion with the body portion being sufficiently flexible to be manually squeezed inwardly. Such a container is commonly used to store hydrocarbon fluid such as motor oil and transmission fluid. These known storage containers are one-piece, thin-walled bottles having intergrally formed body and neck portions. The sealing closure of this invention may be used in combination with such a known storage bottle.

The neck portion extends from the body portion at one end thereof to a discharge opening defined by a peripheral wall edge at the other end thereof. Sealing means is effective to contain liquid within the inverted container means when the liquid therein would otherwise pour out of the discharge opening. Therefore, the inverted bottle discharge opening may be first registered with a receiving liquid inlet without spilling the liquid in the process.

The sealing means has a structural configuration effective to break open allowing gravitational liquid flow from the discharge opening when the body portion of the inverted container means is manually squeezed inwardly. Such manual squeezing occurs only after the discharge opening is located over a receiving liquid inlet as found in an engine valve cover. The sealing means is designed for a one-time use.

A feature of the invention comprises a sealing means including frangible membrane means and means for securing the membrane means to the peripheral wall edge defining the discharge opening. The securing means includes a fixed section and a tacked section. The tacked section has an adhering strength less than the adhering strength of the fixed section. When additional internal pressure is caused by manually squeezing the inverted container means, the fixed section remains fixed to the structure of the container means and the tacked section parts therefrom to allow liquid flow from the discharge opening.

In a specific embodiment, the fixed section includes a delimited distance along the peripheral wall edge defining an area to keep the membrane means fixed thereto when, under additional internal pressure, the membrane means breaks open along the tacked section. The tacked section includes a delimited distance along the peripheral edge and is effective to keep the membrane means secured thereto when inverting the container means before the additional internal pressure is caused by manually squeezing the container means.

In another embodiment, the membrane means contains two membrane members composed of a thin film material such as aluminum foil or a polymer plastic film. The tacked section includes a defined area between overlapped portions of the two membrane members. The securing means includes adhesive material used to form fixed and tacked sections. The adhesive material in the tacked section has an adhering strength less than the adhesive material in the fixed section.

Another feature of the invention comprises a bursting open portion which includes a weakened section formed in the membrane means. The weakened section has an initial breaking strength less than the remaining portion of the membrane means and is effective to part thereby allowing gravitational liquid flow from the discharge opening upon manual squeezing of the inverted container means.

In a specific embodiment, the weakened section includes at least one tear line extending along the membrane means across the discharge opening. In a further embodiment, the weakened section includes an overlapping flap means of a first membrane member tacked to a second membrane member underneath the flap means. The second membrane member includes an open area and a tear line extending from the open area across the membrane means.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 1 is a fragmentary perspective view showing the liquid storage container of the invention with the membrane in an open or broken condition for allowing gravitational liquid flow when the container is inverted;

FIG. 2 is a fragmentary perspective view of another embodiment of a storage container with a dispensing closure of the invention in a sealed condition;

FIG. 2*a* is a fragmentary perspective view of the container of FIG. 2 in an opened condition after being manually squeezed inwardly;

FIG. 3 is a fragmentary perspective view of a further embodiment of the type storage container as shown in FIG. 2;

FIG. 4 is a fragmentary perspective view of a fourth embodiment of a storage container of the invention shown in a sealed condition;

FIG. 4*a* is a fragmentary perspective view of the container of FIG. 4 shown in an opened or broken condition;

FIG. 5 is fragmentary perspective view of a fifth embodiment of a storage container of the invention shown in a sealed condition;

FIG. 5*a* is a fragmentary perspective view of the container of FIG. 5 shown in an opened condition;

FIG. 6 is a fragmentary perspective view of a sixth embodiment of a storage container of the invention shown in a sealed condition;

FIG. 6*a* is a fragmentary perspective view of the container of FIG. 6 shown in an opened condition; and FIG. 7 is a perspective view of an inverted storage container discharging liquid material upon manual squeezing thereof.

DETAILED DESCRIPTION

The neck portion at the outer end of a storage container, generally designated 10, includes threads 11 located around the discharge opening in a known manner. The thin-walled plastic storage container of this embodiment is used for storing motor oil, transmission fluid and the like. A peripheral wall edge defines the discharge opening as shown in the drawings.

Flexible container 10 includes a body portion and a neck portion as shown inverted in FIG. 7 with the body portion being manually squeezed inwardly. Each of the embodiments are shown with storage container 10 in an upright condition for illustration. Each disclosed sealing closure prevents contained liquid from being discharged when container 10 is first inverted but is broken open when inverted container 10 is manually squeezed.

The membrane means in FIGS. 2, 3, 4, 5 and 6 are shown in a closed or sealed condition. To discharge the liquid from inverted container 10, the flexible body portion is simply squeezed thereby causing additional internal pressure to break open the sealing closure allowing gravitational liquid flow from the discharge opening as shown in FIG. 7.

Use of an adhesive material for fixing a membrane completely around the peripheral edge of the discharge opening is know as a tamper-proof seal. To open the known membrane, it is necessary to puncture the frangible material of the membrane for discharging the contents upon inverting the container.

In the embodiment of FIG. 1, a single membrane member 12 adheres to the peripheral edge around the discharge opening by two different types of adhesive materials. A first adhesive material is used in a fixed section 13 and a second, tacking adhesive is used in a tacked section 14. The adhesive material in fixed section 13 holds membrane 12 securely to the edge of the discharge opening when the additional internal, squeezing pressure overcomes the tacking strength of the second adhesive material to part membrane 12 from the peripheral edge of bottle 10. Fixed section 13 prevents any portion of membrane 12 from entering into the liquid receiving inlet for an engine.

Each disclosed dispensing closure breaks open under additional internal pressure when storage bottle 10 is manually squeezed inwardly after being inverted. In each instance, the membrane breaks without any portion of the membrane being carried along by the discharging liquid.

The tacking adhesive holds the membrane means securely against the peripheral edge of the bottle material or an overlapped area in inverted container 10 as shown in FIGS. 5 and 6 i.e. the weight of the contained liquid alone is insufficient to overcome the tacking strength of the adhesive. Tacking adhesives are well known and their strength can be varied accordingly by the skilled artisan to achieve the desired results based upon the size of container 10 and the weight of the material contained therein. When container 10 is manually squeezed to produce an internal pressure in addition to the liquid weight contained therein, the strength of the tacked section will be overcome thereby parting as shown in FIGS. 1, 5 and 6.

The embodiments of FIGS. 2 and 3 include respective membranes 15 and 18, securely fixed around the entire peripheral wall edge of storage bottle 10. Membrane 15 includes tear lines 16 and 17 in a cross configuration and membrane 18 includes a plurality of tear lines 19 in a star configuration. Upon inverting container 10 in each of these embodiments, each tear line configuration is sufficient to hold the weight of the contained liquid.

Upon squeezing flexible bottle 10, tear lines 16, 17 and 19 are caused to burst open as shown in FIG. 2*a*. The tears should be clean so that none of the membrane material is carried along by the discharging liquid. The weight of the contained liquid together with additional internal pressure caused by squeezing should open the discharge opening sufficiently to allow the contents to be completely discharged.

As shown, each of the embodiments provide a one-time inverting and squeezing operation. The closure mechanism is particularly suitable for dispensing the entire liquid contents from the container opening. The standard type of tamper proof cap is threaded onto threads 11 in a well known manner. The same type of threaded configuration of FIG. 1 is usable on each of the other embodiments as shown.

The embodiment of FIG. 4 incorporates both concepts of the earlier embodiments. Tear line 21 extends across membrane 20 and breaks under pressure. Tacked sections 23 extends a delimited distance along opposing sides of the peripheral edge at either end of tear strip 21. Under the internal, squeezing pressure plus the weight of the contained liquid, flaps 20*a* and 20*b* separate from the peripheral wall edge. At the same time, a fixing adhesive material firmly secures the separated sections of membrane 20 along fixed sections 22 on opposing sides of the discharge opening.

In FIG. 5, membrane members 24 and 25 fixedly adhere to the peripheral edge of the discharge opening for bottle 10. An overlapping flap section 26 is tacked with a tacking adhesive material to the top of membrane member 25. The bottom membrane member 25 includes an open area 27 and tear lines 28 and 29 extending outwardly therefrom. When container 10 is manually squeezed as shown in FIG. 7, the pressure and weight acting through open area 27 cause flap section 26 to separate along tacked section 31.

Further, membrane 25 will tear along lines 28 and 29 to enhance gravitational liquid flow from the discharge opening. Flap member 25 remains adhered by an adhesive along fixed section 30. Overlapping membrane member 24 is fixedly secured with adhesive outside tacked section 31 to insure that none of member membrane 24 separates from container 10 during the discharge operation.

In FIG. 6, top membrane member 35 overlaps bottom membrane member 32. Opening 33 and tear strip 34 are covered by membrane 35 along tacked section 37. The tacking adhesive material of tacked section 37 has an adhering strength less than the adhesive strength used along fixed sections 36 and 32*a* at outer edges of membranes 32 and 35.

Upon squeezing inverted container 10 the liquid material weight and additional internal pressure through opening 33 causes flap membrane member 35 to part along tacked section 37 and membrane 32 to tear at least along line 34. Thus, the discharge neck opening is in a broken condition while no portion of either membrane member 32 or 35 is carried along by the gravitational flow of liquid 38.

Membrane members 15, 18 and 20 may include minute holes or perforations to aid in the tearing or bursting process. Such holes should be small enough to prevent spilling liquid from the inverted container 10 until the neck discharge opening has been registered with the liquid receiving inlet. Any use of holes or perforations also depend upon the degree to which the membrane member is to be tamper proof.

While the liquid storage container with dispensing closure has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. The combination comprising:

(a) container means including a body portion and a neck portion;

(b) an amount of liquid material disposed within the container means for storage thereof;

(c) the neck portion extends from the body portion at one end thereof to a discharge opening defined by a peripheral wall edge at the other end thereof, said wall edge end having a uniform width around the entire discharge opening;

(d) sealing means effective to contain the liquid when the container means is inverted to otherwise cause the liquid therein to pour out of the discharge opening;

(e) said sealing means includes membrane means and adhesive means for securing the membrane means to said uniform width wall edge around the discharge opening;

(f) said securing adhesive means includes a fixed adhesive section a delimited distance along said wall edge end and a tacked adhesive section along said wall edge end to keep the membrane means fixed thereto when the membrane means parts along the tacked adhesive section;

(g) said tacked adhesive section having an adhering strength less than the adhering strength of said fixed adhesive section;

(h) said fixed adhesive section remaining fixed to said uniform width wall edge end and said tacked adhesive section becoming unsecured therefrom;

(i) the membrane means includes two membrane members composed of a thin film material with one membrane member being overlapped onto the other membrane member; and (j) the tacked adhesive section includes a defined area between overlapped portions of the two membrane members.

2. The combination comprising:

(a) container means including a body portion and a neck portion;

(b) an amount of liquid material disposed within the container means for storage thereof;

(c) the neck portion extends from the body portion at one end thereof to a discharge opening defined by a peripheral wall edge at the other end thereof, said wall edge end having a uniform width around the entire discharge opening;

(d) sealing means effective to contain the liquid when the container means is inverted to otherwise cause the liquid therein to pour out of the discharge opening;

(e) said sealing means includes membrane means and adhesive means for securing the membrane means to said uniform width wall edge around the discharge opening;

(f) said securing adhesive means includes a fixed adhesive section a delimited distance along said wall edge end and a tacked adhesive section along said wall edge end to keep the membrane means fixed thereto when the membrane means parts along the tacked adhesive section;

(g) said tacked adhesive section having an adhering strength less than the adhering strength of said fixed adhesive section;

(h) said fixed adhesive section remaining fixed to said uniform width wall edge end and said tacked adhesive section becoming unsecured therefrom;

(i) the membrane means includes two membrane members composed of a thin film material with one membrane member being overlapped onto the other membrane member; and (j) the tacked adhesive section includes a defined area between overlapped portions of the two membrane member;

(k) the said other membrane member under said one overlapping membrane member being frangible.

3. The combination comprising:

(a) flexible container means including a body portion and a neck portion;

(b) said body portion being sufficiently flexible to allow manual squeezing inwardly thereof;

(c) an amount of liquid material disposed within the container means for storage thereof;

(d) the neck portion extends from the body portion at one end thereof to a discharge opening defined by a peripheral wall edge at the other end thereof, said wall edge end having a uniform width around the entire discharge opening;

(e) sealing means effective to contain the liquid when the container means is inverted to otherwise cause the liquid therein to pour out of the discharge opening;

(f) said sealing mean includes membrane means and adhesive means for securing the membrane means to said uniform width wall edge around the discharge opening;

(g) said securing adhesive means includes a first adhesive material used to form a fixed adhesive section and a second adhesive material used to form a backed adhesive section;

(h) the fixed adhesive section includes a delimited distance along the peripheral wall edge end to keep the membrane means fixed thereto when the membrane means parts along the tacked adhesive section under additional internal pressure caused by manually squeezing the inverted container means;

(i) said adhesive material in the tacked section having an adhering strength less than the adhering strength of the adhesive material in said fixed adhesive section;

(j) said fixed adhesive section remaining fixed to said uniform width wall edge end and said tacked adhesive section becoming unsecured therefrom.

4. The combination as defined in claim 3 wherein there is a measured amount of liquid material in the container means.

5. The combination as defined in claim 3 wherein the flexible container means comprises a one-piece, thin-walled bottle having integrally formed body and neck portions.

6. The combination as defined in claim 3 wherein the tacked adhesive section includes a delimited distance along the peripheral wall edge and is effective (a) to have the membrane means adhesively secured thereto when the container means is inverted and (b) to part the membrane means therefrom.

7. The combination as defined in claim 3 wherein the liquid material is a hydrocarbon fluid.

8. The combination as defined in claim 7 wherein the hydrocarbon fluid is motor oil or transmission fluid.

9. The combination as defined in claim 3 wherein the membrane means includes two membrane members composed of a thin film material; and the tacked adhesive section includes a defined area between overlapped portions of the two membrane members.

10. The combination as defined in claim 9 wherein the membrane member beneath the overlapped tacked section includes an open area effective to direct a force from the weight of the contained liquid and additional squeezing pressure to impinge upon the upper overlapped membrane member.

11. The combination as defined in claim 3 wherein said sealing membrane means includes a membrane member composed of a thin film material.

12. The combination as defined in claim 11 wherein said film material comprises aluminum foil.

13. The combination as defined in claim 11 wherein said film material comprises a polymer plastic film.

* * * * *